US009334869B2

(12) United States Patent
Kang et al.

(10) Patent No.: US 9,334,869 B2
(45) Date of Patent: May 10, 2016

(54) AXIAL COMPRESSOR AND CONTROL METHOD THEREOF TO STABILIZE FLUID

(75) Inventors: Young Seok Kang, Daejeon (KR); Soo Seok Yang, Daejeon (KR); Hyung Soo Lim, Seoul (KR); Hyo Jo Bae, Seoul (KR); Seung Jin Song, Seoul (KR); Shin Hyoung Kang, Seoul (KR)

(73) Assignee: Korea Aerospace Research Institute, Daejeon (KR)

( * ) Notice: Subject to any disclaimer, the term of this patent is extended or adjusted under 35 U.S.C. 154(b) by 438 days.

(21) Appl. No.: 13/977,024

(22) PCT Filed: Feb. 28, 2011

(86) PCT No.: PCT/KR2011/001401

§ 371 (c)(1),
(2), (4) Date: Jun. 28, 2013

(87) PCT Pub. No.: WO2012/091216

PCT Pub. Date: Jul. 5, 2012

(65) Prior Publication Data

US 2013/0272845 A1 Oct. 17, 2013

(30) Foreign Application Priority Data

Dec. 30, 2010 (KR) ..... 10-2010-0139262

(51) Int. Cl.

| | |
|---|---|
| ***F04D 27/00*** | (2006.01) |
| ***F04D 15/00*** | (2006.01) |
| ***F04D 15/02*** | (2006.01) |
| ***F04D 19/02*** | (2006.01) |
| ***F04D 27/02*** | (2006.01) |
| ***F04D 29/56*** | (2006.01) |
| ***F04D 29/68*** | (2006.01) |

(52) U.S. Cl.

CPC ..... *F04D 27/00* (2013.01); *F04D 15/0044* (2013.01); *F04D 15/0245* (2013.01); *F04D 19/02* (2013.01); *F04D 27/0284* (2013.01); *F04D 29/563* (2013.01); *F04D 29/684* (2013.01); *F05D 2270/101* (2013.01)

(58) Field of Classification Search

CPC ..... F04D 15/0044; F04D 15/0245; F04D 15/0281; F04D 19/02; F04D 27/02; F04D 27/001; F05D 2270/101

See application file for complete search history.

(56) References Cited

U.S. PATENT DOCUMENTS 5,275,528 A * 1/1994 Freeman ..... F04D 27/0207 415/1
5,340,271 A * 8/1994 Freeman ..... F04D 27/0215 415/1

(Continued)

FOREIGN PATENT DOCUMENTS

EP 0543908 9/1996

*Primary Examiner* — Ninh H Nguyen
(74) *Attorney, Agent, or Firm* — Hammer & Associates, P.C.

(57) ABSTRACT

A fluid stabilizing control method of an axial compressor is provided, which includes driving to drive the axial impeller, and stall controlling to suppress or prevent an occurrence of a stall that may transpire during rotation of the axial impeller by supplying highly-pressurized compressed air into the casing through a stall controller according to a predetermined time and volume. Accordingly, a stall may be suppressed or prevented, the occurrence of a stall that may transpire when a threshold point is exceeded by an unexpected event during driving in a low-flow high-pressure section on a performance curve, in which efficiency is high. Additionally, since an air injection method for suppressing the stall is properly applied, an amount of power expended for the stall control may be reduced while supply of the high-pressure compressed air is minimized, thereby achieving economically feasible stall control.

5 Claims, 7 Drawing Sheets

(56) References Cited

U.S. PATENT DOCUMENTS 5,984,625 A * 11/1999 Murray ..... F04D 27/02
415/1

6,098,010 A * 8/2000 Krener ..... F04D 27/001
105/64.1

2003/0007860 A1 1/2003 Nakajima et al.

2008/0101922 A1 5/2008 Schirle et al.

* cited by examiner

AXIAL COMPRESSOR AND CONTROL METHOD THEREOF TO STABILIZE FLUID

TECHNICAL FIELD

The present invention relates to an axial compressor and a control method for stabilizing a fluid in an axial compressor, and more particularly, to an axial compressor capable of suppressing or preventing an occurrence of a stall when a threshold point is exceeded by an unexpected event during driving in a low-flow high-pressure section having a high efficiency on a performance curve of the axial compressor, and a control method for stabilizing a fluid in the axial compressor.

BACKGROUND ART

An axial compressor is capable of generating a great output and therefore is widely used for jet engines, gas turbines, oxygen producers, chemical plants, and the like. The axial compressor is applied in various fields since it is capable of achieving a minute vibration, a high efficiency, a high speed rotation, and a small size.

Schematically, the axial compressor is structured in such a manner that rotors and stators fixed to a casing are alternately arranged.

In a conventional axial impeller used as the axial compressor, a stall may occur when a threshold point is exceeded by an unexpected event during driving in a low-flow high-pressure section on a performance curve, in which efficiency is high.

To resolve such a limitation, specific conditions for optimizing the effect have been analyzed in terms of a number of injection nozzles for injecting a fluid, a nozzle shape, a nozzle arrangement, an injection type, a nozzle angle, a nozzle flow volume, and the like. However, such research is still in the early stages with almost no technology currently being commercialized.

Furthermore, due to technological characteristics, the foregoing conditions need to be experimentally verified, which requires a great deal of expenditure and time. Also, since conducting a compressor stability experiment is extremely dangerous, almost no research has been conducted via experiments.

Accordingly, there is an increasing demand for a fluid stabilizing control method capable of suppressing or preventing an occurrence of a stall that may transpire during driving of an axial compressor.

DISCLOSURE OF INVENTION

Technical Goals

An aspect of the present invention provides an axial compressor that suppresses or prevents an occurrence of a stall when a threshold point is exceeded by an unexpected event during driving in a low-flow high-pressure section having a high efficiency on a performance curve of the axial compressor, and a control method for stabilizing a fluid in the axial compressor.

Another aspect of the present invention provides an axial compressor that reduces an amount of power expended for suppressing a stall by properly controlling an air injection method and, furthermore, minimizes use of a highly-pressurized air, thereby achieving economically feasible stall control, and a control method for stabilizing a fluid in the axial compressor.

Technical Solutions

According to an aspect of the present invention, there is provided an axial compressor including a casing which configured to include a plurality of stators provided on an inner surface and such that a fluid as a compression object is introduced and discharged, an axial impeller configured to rotate within the casing and to include a plurality of rotors arranged between neighboring stators of the plurality of stators, and a stall controller configured to suppress or prevent a stall that may occur during rotation of the axial impeller by supplying highly-pressurized compressed air into the casing according to a preset time and volume. According to the structure, the occurrence of a stall may be suppressed or prevented, the occurrence of the stall that may transpire when a threshold point is exceeded by an unexpected event during driving in a low-flow high-pressure section on a performance curve, in which efficiency is high. Additionally, by properly controlling air injection method for suppressing the stall, an amount of power expended for the stall control may be reduced. Also, since supply of the highly-pressurized compressed air is minimized, economically feasible stall control may be achieved.

The stall controller may include a pulsator mounted on a transfer line which connects an injection nozzle for injecting compressed air into the casing with a blower for supplying highly-pressurized compressed air, so as to pulsatively inject the highly-pressurized compressed air.

The pulsator may increase a supplied volume of the compressed air in a stepwise manner after injection of the highly-pressurized compressed air begins.

The pulsator may increase a supplied volume of the highly-pressurized compressed in a linear manner air after injection of the compressed air begins.

The stall controller may inject the highly-pressurized compressed air into the casing by a fixed injection method before the axial impeller goes into an unstable region during driving.

The stall controller may inject the highly-pressurized compressed air into the casing by a stepwise injection method before the axial impeller goes into an unstable region during driving.

According to an aspect of the present invention, there is provided a fluid stabilizing control method of an axial compressor including a casing and an axial impeller that compresses a fluid by rotating the axial impeller in the casing, the control method including driving to drive the axial impeller, and stall controlling to suppress or prevent an occurrence of a stall that may transpire during rotation of the axial impeller by supplying highly-pressurized compressed air into the casing through a stall controller according to a predetermined time and volume.

In the stall controlling, the stall controller may include a pulsator configured to inject the highly-pressurized compressed air into the casing by a pulsed injection method before the axial impeller goes into an unstable region during driving.

In the stall controlling, the stall controller may inject the highly-pressurized compressed air into the casing by a linear injection method before the axial impeller goes into an unstable region during driving.

In the stall controlling, the stall controller may inject the highly-pressurized compressed air into the casing by a combination of a linear injection method and a pulsed injection method, before the axial impeller goes into an unstable region during driving.

In the stall controlling, the stall controller may inject the highly-pressurized compressed air into the casing by a fixed injection method before the axial impeller goes into an unstable region during driving.

In the stall controlling, the stall controller may inject the highly-pressurized compressed air into the casing by a stepwise injection method before the axial impeller goes into an unstable region during driving.

Effects of Invention

According to an example of the present invention, an occurrence of a stall may be suppressed or prevented, the occurrence of a stall that may transpire when a threshold point is exceeded due to an unexpected event during driving in a low-flow high-pressure section on a performance curve, in which efficiency is high.

In addition, according to an embodiment of the present invention, since an air injection method for suppressing the occurrence of a stall is properly applied, an amount of power expended for the stall control may be reduced. Also, since supply of the highly-pressurized compressed air is minimized, the stall control may be performed economically.

BEST MODE FOR CARRYING OUT THE INVENTION

Figure 1:
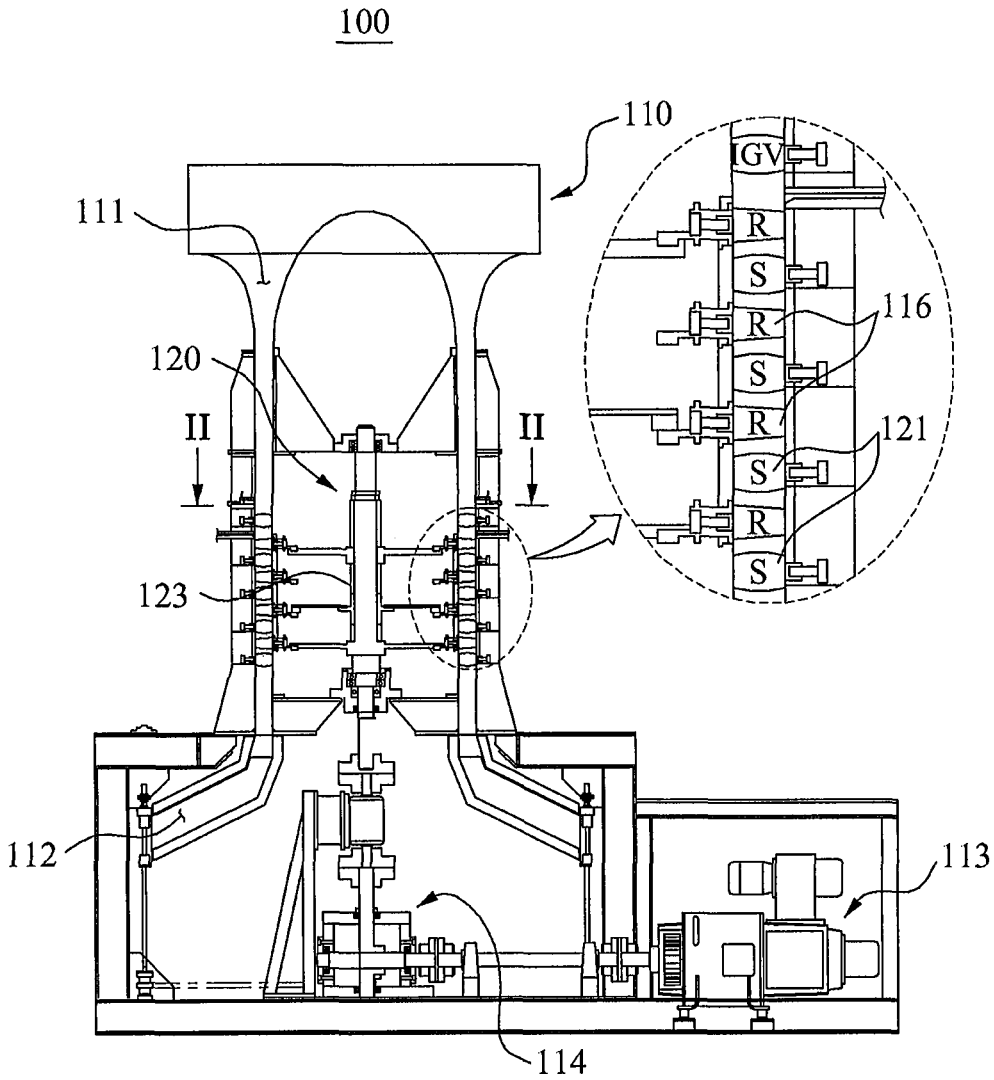
FIG. 1 is a conceptual diagram illustrating an inner structure of an axial compressor according to an embodiment of the present invention.

Reference will now be made in detail to embodiments of the present invention, examples of which are illustrated in the accompanying drawings, wherein like reference numerals refer to the like elements throughout. The following description illustrates one of various aspects of the present invention and constitutes part of a detailed description about the present invention.

However, in explaining the embodiments of the present invention, generally known functions and structures will not be explained in detail for conciseness.

Figure 2:
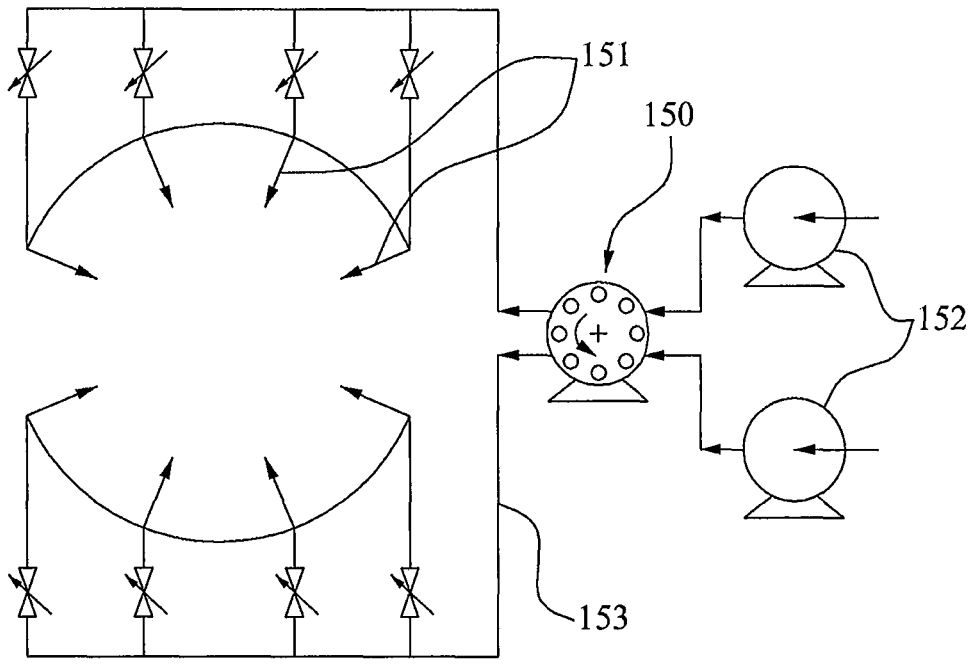
FIG. 2 is a diagram illustrating a part of the structure of the axial compressor shown in FIG. 1, cut along a line II-II.

FIG. 1 illustrates an inner structure of an axial compressor 100 according to an embodiment of the present invention. FIG. 2 illustrates a part of the structure of the axial compressor shown in FIG. 1, cut along a line II-II.

Referring to FIGS. 1 and 2, the axial compressor 100 according to the embodiment of the present invention includes a casing 110 forming an external appearance, an axial impeller 120, and a stall controller 150 which suppresses or prevents an occurrence of a stall that may transpire at the time of driving of the axial impeller 120.

Among the foregoing structures, the casing 110 will be described first. As shown in FIG. 1, the axial impeller 120 is mounted to the casing 110 to be axially rotatable. The casing 110 includes an inlet 111 to receive a fluid and an outlet 111 to discharge a compressed fluid. In addition, the casing 110 may further include a driver 113 to generate a driving force for rotating the axial impeller 120, and a driving force transmitter 114 to receive the driving force from the driver 113 and thereby directly rotating the axial impeller 120.

Here, the driver 113 may include a direct current (DC) motor. The driving force transmitter 114 may include a gear structure.

A plurality of stators 116 may be provided to an inner surface of the casing 110 in which the axial impeller 120 rotates. The plurality of stators 116 may correspond to a plurality of rotors 112 of the axial impeller 120 that will be described hereinafter. Referring to FIG. 1, each stator 116 may be protruded from the inner surface of the casing 110. A plurality of the stators 116 may be arranged in a vertical direction of the axial impeller 120. The plurality of stators 116 may increase a static pressure of a fluid introduced in the axial impeller 120 in interaction with the plurality of rotors 121 of the axial impeller 120.

The axial impeller 120 is a part actually compressing the fluid through being rotated. The axial impeller 120 may include a rotational shaft 123 axially rotating in connection with the driving force transmitter 114, and the plurality of rotors 121 extended outward from an outer surface of the rotational shaft 123 and arranged between respective neighboring stators 116.

According to the aforementioned structure, a fluid introduced through the inlet 111 may be compressed while passing through a space between the plurality of rotors 121 of the axial impeller 120 and the plurality of stators 116 being in a static position, and then discharged through the outlet 112.

However, as aforementioned, when a threshold point is exceeded by an unexpected event during driving in a low-flow high-pressure section having a high efficiency on a performance curve of the axial compressor, an occurrence of a stall may transpire. The occurrence of a stall may generate a surge, thereby causing a backflow of the introduced fluid. Furthermore, the occurrence of a stall may cause an unstable operation of a system in which the axial impeller 120 is used.

To suppress or prevent the occurrence of a stall, the axial compressor 100 according to an embodiment of the present invention may further include a stall controller 150 to control a stall by controlling an air injection method.

As shown in FIG. 2, the stall controller 150 may be implemented by a pulsator mounted on a transfer line 153 which connects an injection nozzle 151 for injecting compressed air for controlling the stall into the casing 110 with a blower 152 for supplying compressed air, so as to pulsatively inject the compressed air.

Before the axial impeller 120 goes into an unstable region during driving, the pulsator-type stall controller 150 may supply highly-pressurized compressed air by a pulsed injection method into the casing 110 in which the axial impeller 120 rotates, accordingly suppressing or preventing the occurrence of a stall.

For suppression of the stall, a volume of the fluid introduced into the axial impeller 120 is inversely proportional to a volume of the compressed air being injected through the injection nozzle 151. Therefore, when the first occurrence of a stall transpires, the volume of the highly-pressurized compressed air may be reduced. Once the volume of the fluid starts reducing, the volume of the highly-pressurized compressed air may be increased. Such a method is referred to as the stepwise injection method which will be described hereinafter.

Hereinafter, a fluid stabilizing control method of the above-structured axial compressor 100 will be described.

The fluid stabilizing control method of the axial compressor 100 may include driving that drives the axial impeller 120, and stall controlling that suppresses or prevents an occurrence of a stall that may transpire during rotation of the axial impeller 120 by supplying highly-pressurized compressed air into the casing 110 through the stall controller 10 according to a preset time and volume.

The driving may be performed by driving the driver 113 to rotate the axial impeller 120, and introducing a fluid through the inlet 111.

The stall controlling may supply the highly-pressurized compressed air into the casing 110 by the pulsed injection method using the pulsator-type stall controller 150 before the axial impeller 120 goes into an unstable region during driving.

Figure 3:
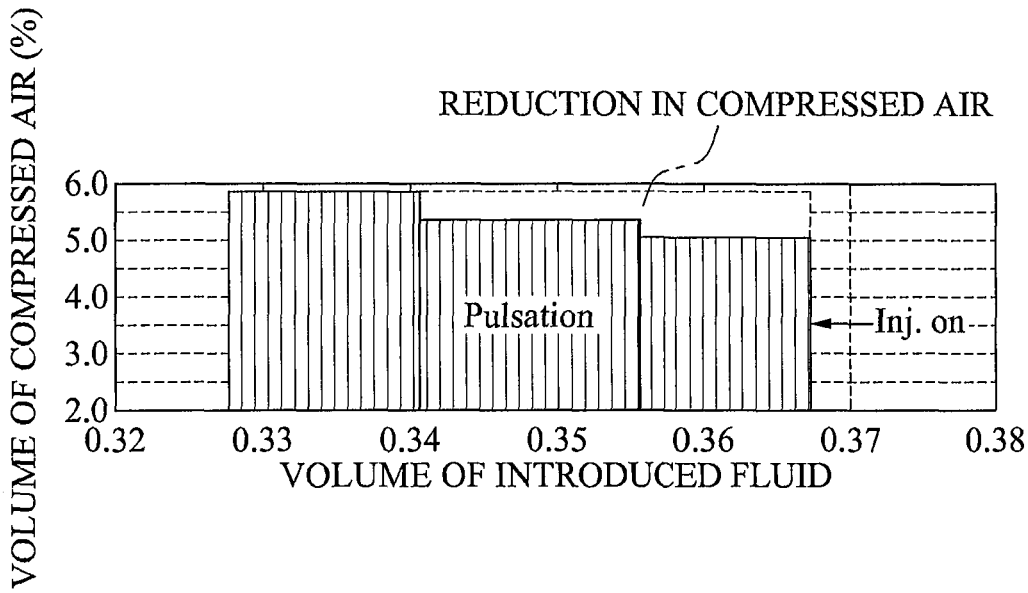
FIGS. 3 and 4 are graphs illustrating a result of an experiment applying an axial compressor according to an embodiment of the present invention.

As a result of an actual experiment applying the pulsator as the stall controller 150 as shown in FIG. 3, it can be understood that the volume of the fluid is reduced when the highly-pressurized compressed air is injected by the pulsed injection method and, accordingly, the stall may be minimized.

Figure 4:
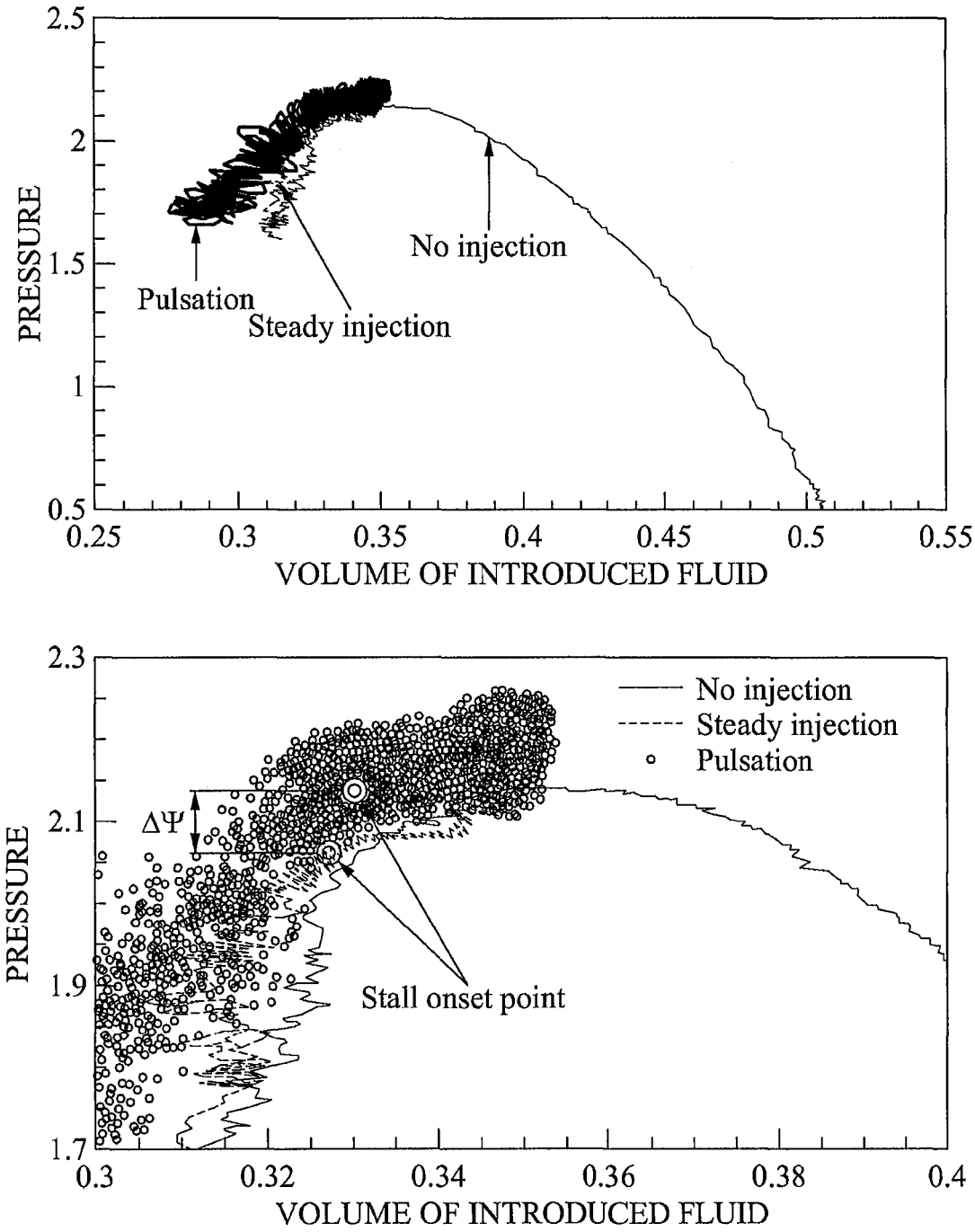

In addition, as shown in FIG. 4, it can be understood that an operation region of the axial impeller 120 may be further reduced when the pulsed injection method is used to reduce the volume of the fluid in the axial impeller 120 when compared to use of a conventional injection method.

Thus, according to the embodiment of the present invention, the occurrence of a stall may be suppressed or prevented, the occurrence of a stall which may transpire when the threshold point is exceeded by an unexpected event during driving in a low-flow high-pressure section having a high efficiency on a performance curve of the axial compressor 100.

Moreover, since the pulsed injection method is properly used as the air injection method for suppressing the stall, an amount of power expended for the stall control may be reduced. Also, since supply of the highly-pressurized compressed air is minimized, the stall control may be performed economically.

Hereinafter, a stall control method of an axial compressor according to another embodiment of the present invention will be described.

Figure 5:
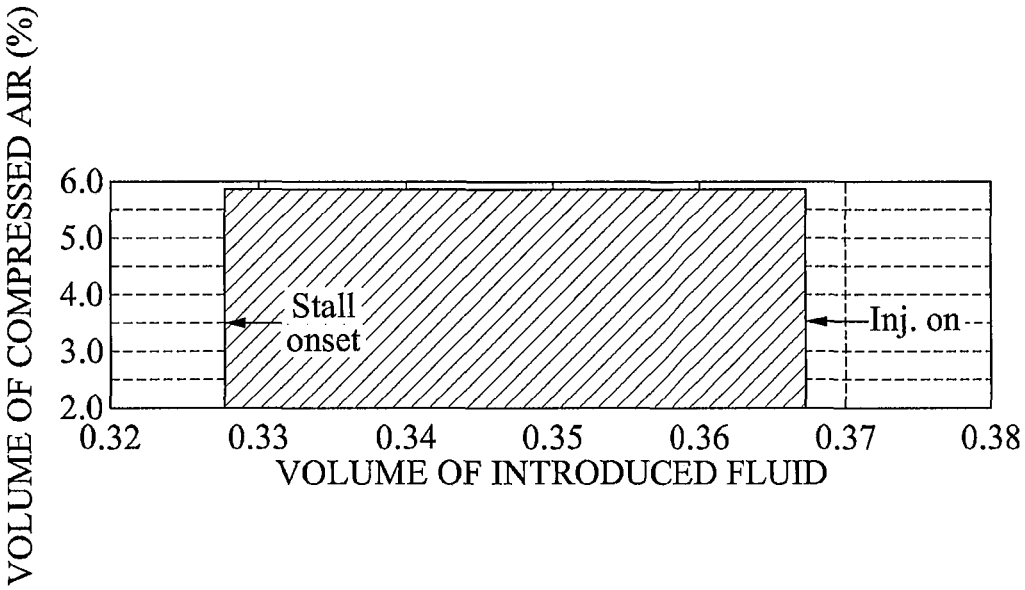
FIG. 5 is a graph illustrating a result of an experiment applying a fixed injection method as a stall control method.

FIG. 5 is a graph illustrating a result of an experiment applying a fixed injection method as the stall control method. As shown in the graph, when highly-pressurized compressed air is constantly supplied through the stall controller before the axial impeller goes into an unstable region during driving, the stall may be suppressed up to a low fluid volume.

Figure 6:
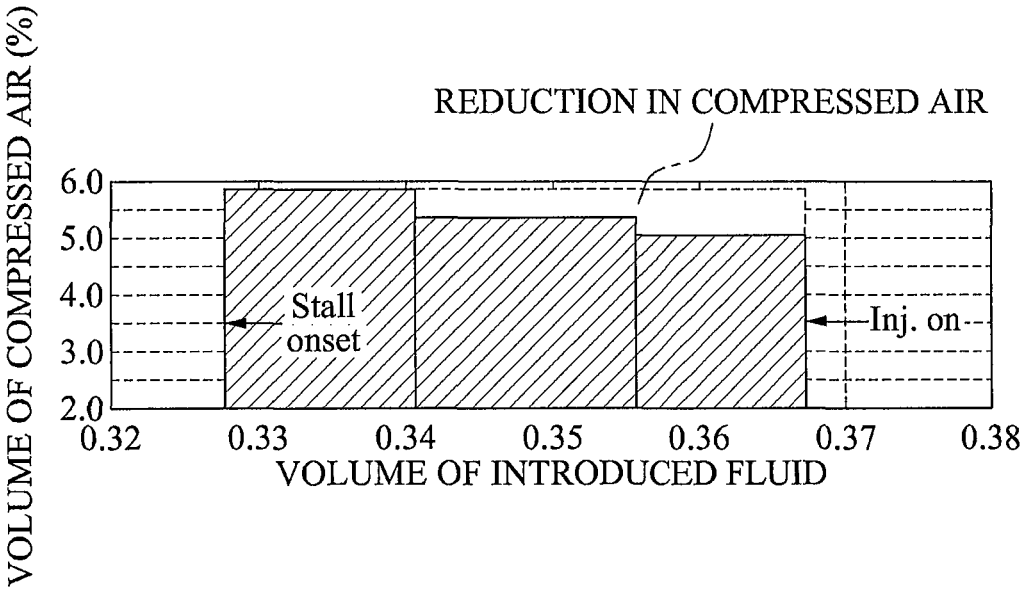
FIGS. 6 and 7 are graphs illustrating a result of an experiment applying a stepwise injection as the stall control method.
Figure 7:
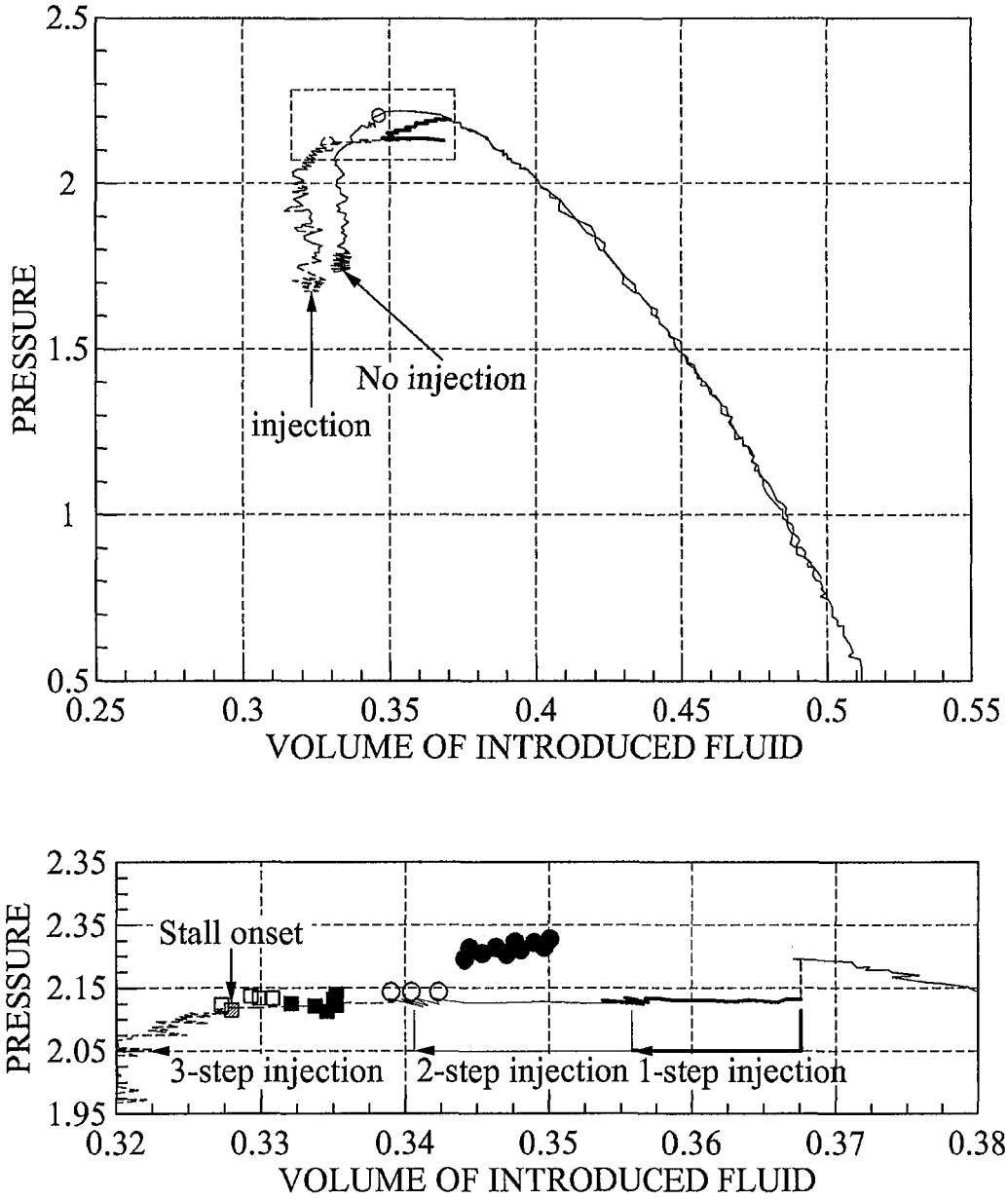

FIGS. 6 and 7 are graphs illustrating a result of an experiment applying a stepwise injection as the stall control method. Referring to the graphs, since the volume of the introduced fluid of the axial impeller for suppressing the stall is inversely proportional to the volume of the highly-pressurized compressed air being injected through the injection nozzle, the volume of the highly-pressurized compressed air may be reduced in the beginning of injection. As the volume of the introduced fluid is accordingly reduced, the volume of the highly-pressurized compressed air may be increased.

With the foregoing method as well, the stall may be suppressed up to the low fluid volume. In addition, use of the highly-pressurized compressed air which is expensive may be reduced, thereby achieving economically feasible stall control.

Figure 8:
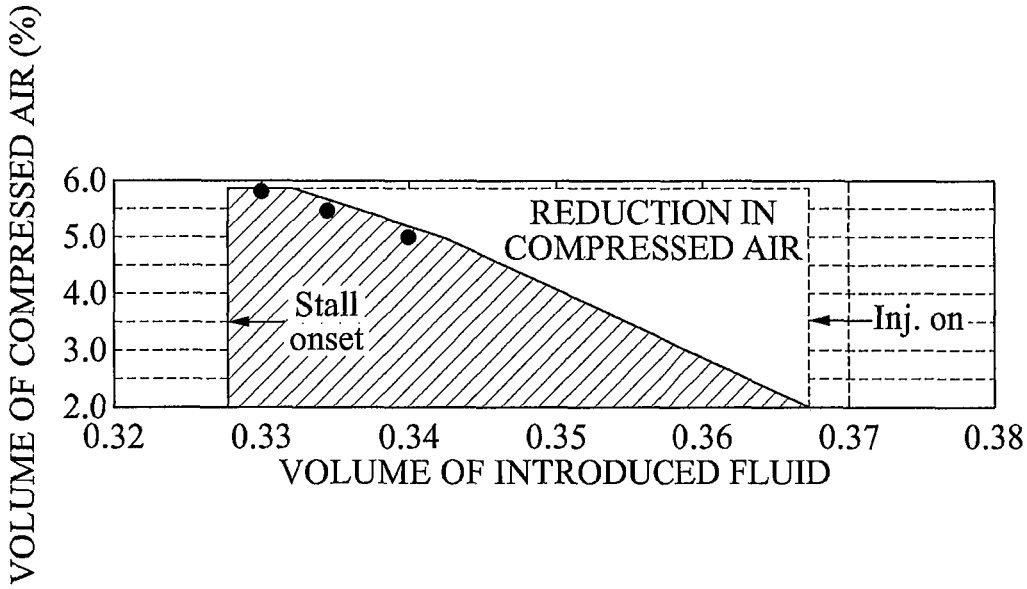
FIG. 8 is a graph illustrating a result of an experiment applying a linear injection method as the stall control method.

FIG. 8 is a graph illustrating a result of an experiment applying a linear injection method as the stall control method. As shown in FIG. 8, even when the compressed air is injected in a linear manner, the stall may be suppressed up to the low fluid volume. Also, as shown in the drawing, use of expensive highly-pressurized compressed air may be reduced, thereby achieving economically feasible stall control.

Figure 9:
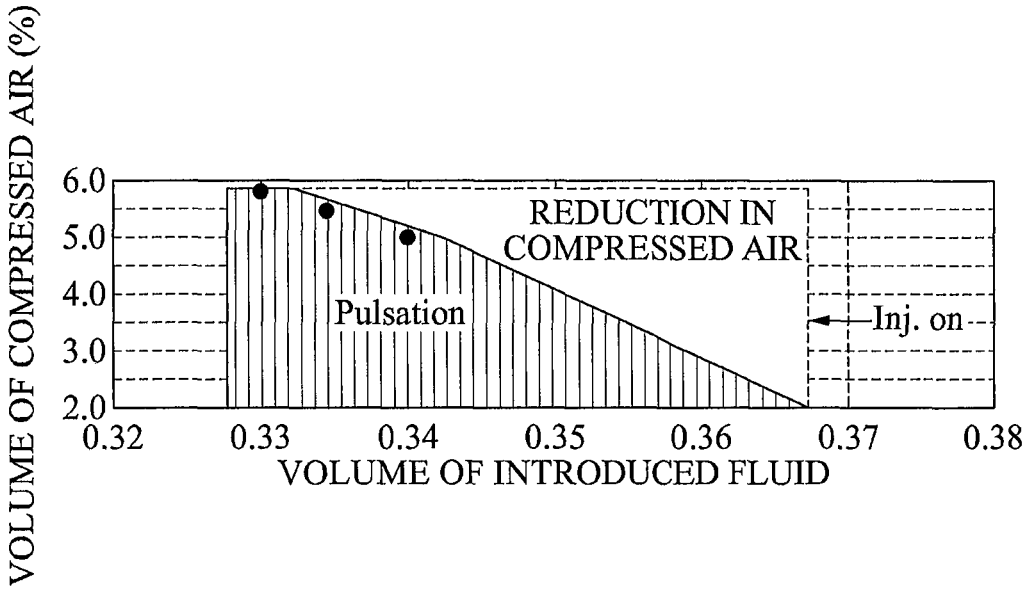
FIGS. 9 and 10 are graphs illustrating a result of an experiment applying both the linear injection method and a pulsed injection method as the stall control method.
Figure 10:
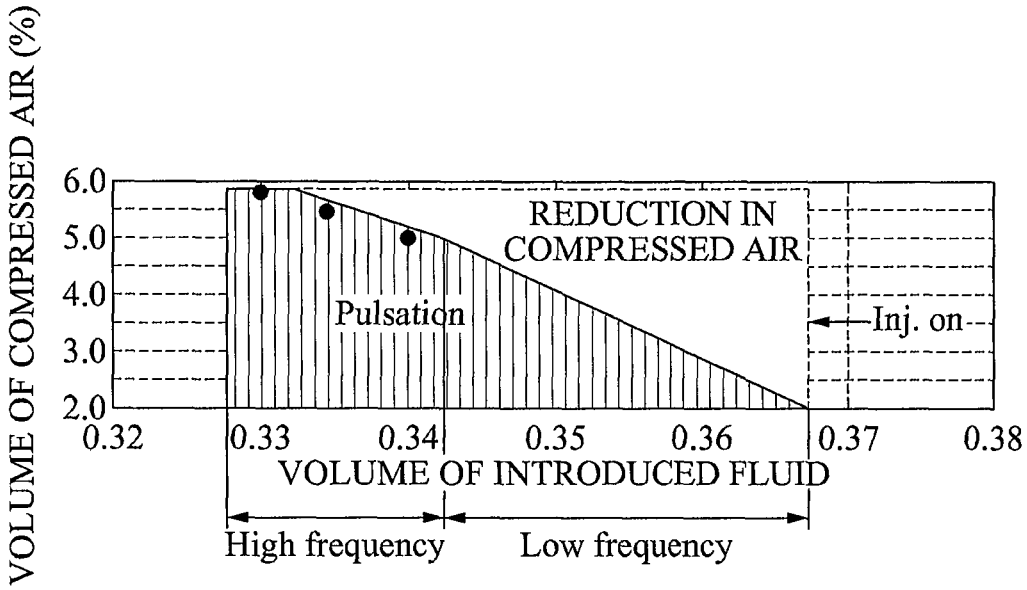

FIGS. 9 and 10 are graphs illustrating a result of an experiment applying both the linear injection method and a pulsed injection method as the stall control method. As shown in the graphs, when the highly-pressurized compressed air is pulsatively injected to linearly increase, the stall may be suppressed up to the low fluid volume. Here, since supply of the highly-pressurized compressed air may be reduced by as much as an amount indicated in FIGS. 9 and 10, economically feasible stall control may be achieved.

As described above, when the pulsed injection method, the linear injection method, the fixed injection method, the stepwise injection method, or a combination of the foregoing methods, for example a linear-pulsed injection method, are applied as the stall control method, occurrence of the stall may be prevented up to the low fluid volume. Additionally, since use of expensive highly-pressurized compressed air is reduced, economical stall control may be achieved.

Although a few embodiments of the present invention have been shown and described, the present invention is not limited to the described embodiments. Instead, it would be appreciated by those skilled in the art that changes may be made to these embodiments without departing from the principles and spirit of the invention, the scope of which is defined by the claims and their equivalents.

INDUSTRIAL APPLICABILITY

Industrial applicability is included in the specification.

The invention claimed is:

1. An axial compressor comprising:

a casing which is configured to include a plurality of stators provided on an inner surface and such that a fluid as a compression object is introduced and discharged;

an axial impeller configured to rotate within the casing and to include a plurality of rotors arranged between neighboring stators of the plurality of stators; and a stall controller configured to suppress or prevent an occurrence of a stall that may transpire during rotation of the axial impeller by supplying highly-pressurized compressed air into the casing according to a predetermined time and volume, wherein the stall controller comprises a pulsator mounted on a transfer line which connects an injection nozzle for injecting highly-pressurized compressed air into the casing with a blower for supplying highly-pressurized compressed air, so as to pulsatively inject the highly-pressurized compressed air.

2. The axial compressor of claim 1, wherein the pulsator increases a supplied volume of the highly-pressurized compressed air in a stepwise manner after injection of the highly-pressurized compressed air begins.

3. The axial compressor of claim 1, wherein the pulsator increases a supplied volume of the highly-pressurized compressed air in a linear method after injection of the highly-pressurized compressed air begins.

4. A fluid stabilizing control method of an axial compressor comprising a casing and an axial impeller that compresses a fluid through being rotated in the casing, the control method comprising:

driving to drive the axial impeller; and stall controlling to suppress or prevent an occurrence of a stall that may transpire during rotation of the axial impeller by supplying compressed air into the casing through a stall controller according to a predetermined time and volume, wherein, in the stall controlling, the stall controller comprises a pulsator configured to inject the highly-pressurized compressed air into the casing by a pulsed injection method before the axial impeller goes into an unstable region during driving.

5. A fluid stabilizing control method of an axial compressor comprising a casing and an axial impeller that compresses a fluid through being rotated in the casing, the control method comprising:

driving to drive the axial impeller; and stall controlling to suppress or prevent an occurrence of a stall that may transpire during rotation of the axial impeller by supplying compressed air into the casing through a stall controller according to a predetermined time and volume, wherein, in the stall controlling, the stall controller injects the highly-pressurized compressed air into the casing by a combination of a linear injection method and a pulsed injection method, before the axial impeller goes into an unstable region during driving.

* * * * *